US009634420B2

(12) United States Patent
Shindo et al.

(10) Patent No.: US 9,634,420 B2
(45) Date of Patent: Apr. 25, 2017

(54) ELECTRICAL CONNECTOR HAVING A RETAINER

(71) Applicant: Tyco Electronics Japan G.K., Kanagawa (JP)

(72) Inventors: Yoshihiko Shindo, Kanagawa (JP); Soichi Sakaguchi, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/848,592

(22) Filed: Sep. 9, 2015

(65) Prior Publication Data

US 2016/0072212 A1 Mar. 10, 2016

(30) Foreign Application Priority Data

Sep. 9, 2014 (JP) ..... 2014-183068

(51) Int. Cl.
*H01R 13/514* (2006.01)
*H01R 13/42* (2006.01)
*H01R 13/436* (2006.01)

(52) U.S. Cl.
CPC ..... *H01R 13/42* (2013.01); *H01R 13/4362* (2013.01)

(58) Field of Classification Search
CPC ..... H01R 13/42; H01R 13/4362
USPC ..... 439/744, 752
See application file for complete search history.

(56) References Cited

U.S. PATENT DOCUMENTS 5,299,958 A * 4/1994 Ohsumi ..... H01R 13/4362 439/752
5,516,308 A 5/1996 Yamanashi
5,839,923 A 11/1998 Yoshida
6,464,544 B1 10/2002 Yamamoto et al.
6,769,940 B2 8/2004 Nakano
6,780,070 B2 8/2004 Ishikawa et al.

FOREIGN PATENT DOCUMENTS

JP 05144499 A 6/1993

OTHER PUBLICATIONS

Abstract of JPH05144499(A), dated Jun. 11, 1993, 2 pages.
European Search Report, EP Application No. 15 18 3341, dated Jan. 19, 2016, 7 pages.

* cited by examiner

*Primary Examiner* — Javaid Nasri
(74) *Attorney, Agent, or Firm* — Barley Snyder

(57) ABSTRACT

An electrical connector has a retainer including a cantilever-type arm that operates with a small force. The retainer is held in the connector housing so as to be movable between a pre-latch position and a complete latch position, retaining terminals at the complete latch position. The retainer has: a first latch on the connector housing at the pre-latch position; a second latch on the connector housing at the complete latch position; a cantilever-type first elastic beam having a free end side formed with the pre-latch projection; and a second elastic beam having both ends supported by the first elastic beam and formed with the complete latch projection.

5 Claims, 9 Drawing Sheets

ELECTRICAL CONNECTOR HAVING A RETAINER

CROSS-REFERENCE TO RELATED APPLICATIONS

This application claims the benefit of the filing date under 35 U.S.C. §119 (a)-(d) of Japanese Patent Application No. 2014-183068 filed Sep. 9, 2014.

FIELD OF THE INVENTION

The invention relates to an electrical connector and, more particularly, to a retainer for an electrical connector.

BACKGROUND

An electrical connector (hereinafter, simply called "connector") having a retainer for retaining a terminal received in a mating connector receiving space of a connector housing (hereinafter, simply called "housing") is known. In the known connector, the retainer is movable between a pre-latch position avoiding interference with the terminal and a complete latch position interfering with the terminal. In the complete latch position the complete latch position prevents the terminal from exiting the housing. Normally, the connector is delivered from a manufacturer to a user in such a state that the retainer is set in the pre-latch position and an operation for moving the retainer from the pre-latch position to the complete latch position is performed by the user. For example, in a case when a change between mating connector receiving spaces where the terminal should be inserted is performed, often the retainer is moved from the pre-latch position to the complete latch position, then operated from the complete latch position to the pre-latch position, and is further operated from the pre-latch position to the complete latch position.

In the known connector, the retainer has a lock structure for latching the retainer to the housing at the pre-latch position and a lock structure for latching the retainer to the housing at the complete latch position.

For example, Japanese Patent No. H05-144499A illustrates a conventional lock structure at the complete latch position, providing a structure where latching is performed using a latch projection having a small projection amount on the retainer to a latch projection formed on the side of the housing. In another conventional example, U.S. Pat. No. 6,780,070 illustrates a structure where a latch projection provided on a cantilever-type arm formed integrally with a retainer provides the latching of the latch projection on the side of the retainer to a latch projection on the side of the housing being performed.

In Japanese Patent No. H05-144499A, the structure having a latch projection with a small projection amount provides a member formed integrally with a high rigidity of the latch projection. Therefore, since the latch projection on the side of the retainer and the latch projection on the side of the housing are brought in contact with each other with a strong force, when a moving operation of the retainer between the pre-latch position and the complete latch position is repeated, distal ends of both the projections are scraped. In a case where the distal ends of the projections are scraped, the latching of the retainer to the housing cannot be performed with a required force.

In U.S. Pat. No. 6,780,070, the cantilever-type arm is bent when the latch projection on the side of the retainer comes in contact with the latch projection on the side of the housing to pass over the same with a reduced force by which both latch projections are brought into contact with each other. In this case, both the projections can be prevented from being scraped. In this structure, however, since an operational force for bending the cantilever-type arm when moving between the pre-latch position and the complete latch position is large, operability is poor.

SUMMARY

An electrical connector has a retainer including a cantilever-type arm that operates with a small force. The retainer is held in the connector housing so as to be movable between a pre-latch position and a complete latch position, retaining terminals at the complete latch position. The retainer has: a first latch on the connector housing at the pre-latch position; a second latch on the connector housing at the complete latch position; a cantilever-type first elastic beam having a free end side formed with the pre-latch projection; and a second elastic beam having both ends supported by the first elastic beam and formed with the complete latch projection.

BRIEF DESCRIPTION OF THE DRAWINGS

An embodiment of the connector 1 of the invention will be described with reference to the accompanying drawings.

FIG. 8(*a*) shows a state in the course of the pre-latch projection on the side of the retainer passing over the pre-latch projection on the side of housing; FIG. 8(*b*) shows a state where the retainer is located at the pre-latch position, FIG. 8(*c*) shows a state in the course of the complete latch projection on the side of the retainer passing over the complete latch projection on the side of the housing, and FIG. 8(*d*) shows a state where the retainer is located at the complete latch position.

DETAILED DESCRIPTION OF THE EMBODIMENT(S)

The connector 1 includes an arm of a cantilever-type structure, including a feature that allows a moving operation between a pre-latch position of a retainer 20 and a complete latch position thereof to be realized with a small operational force. Specifically, the feature lies in that a second elastic beam is provided in the cantilever-type structure. A configuration of the connector 1 will be described below and an operation/effect of the connector 1 will be described.

Figure 1:
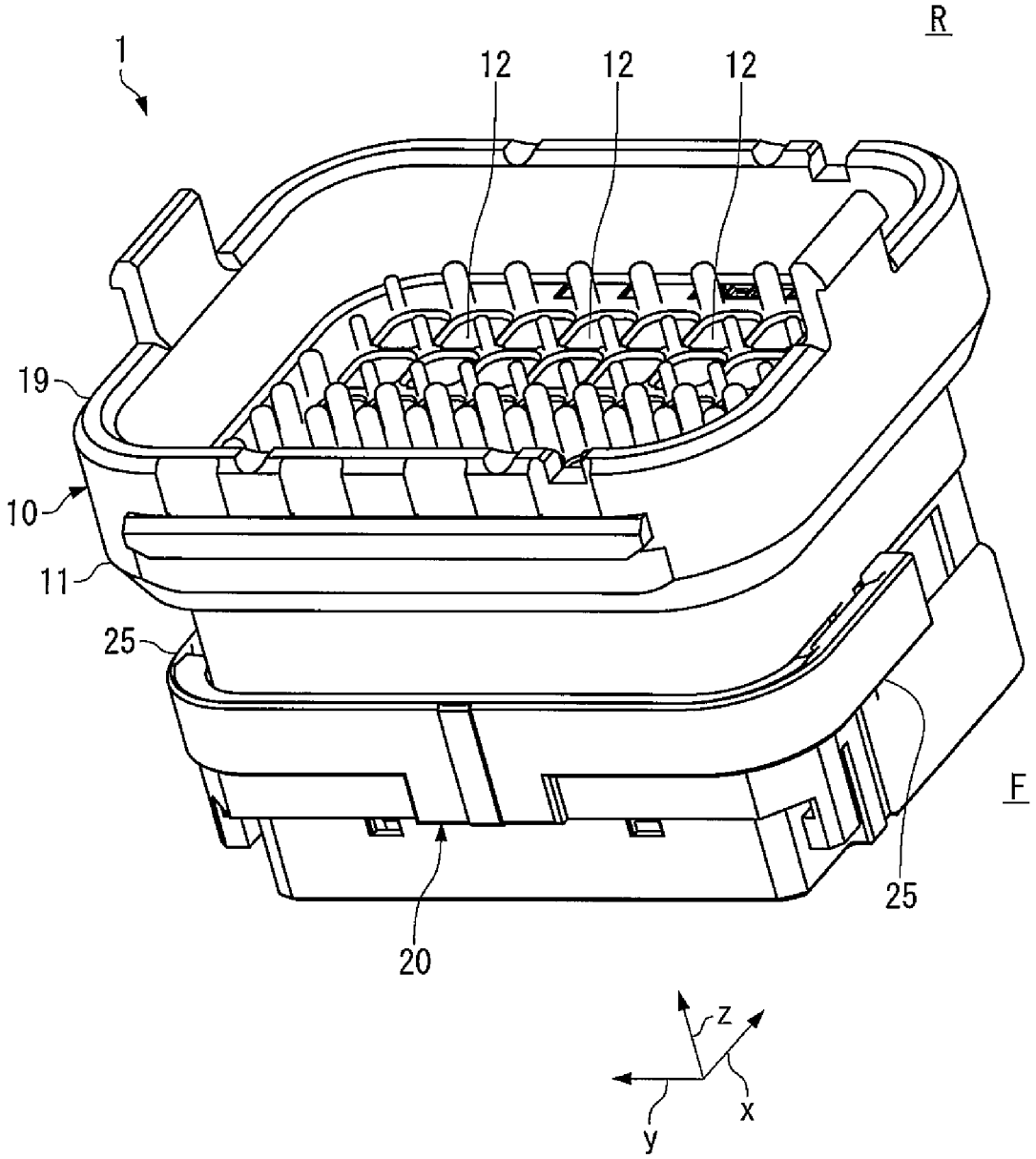
FIG. 1 is a perspective view illustrating a connector showing a retainer attached thereto.
Figure 2:
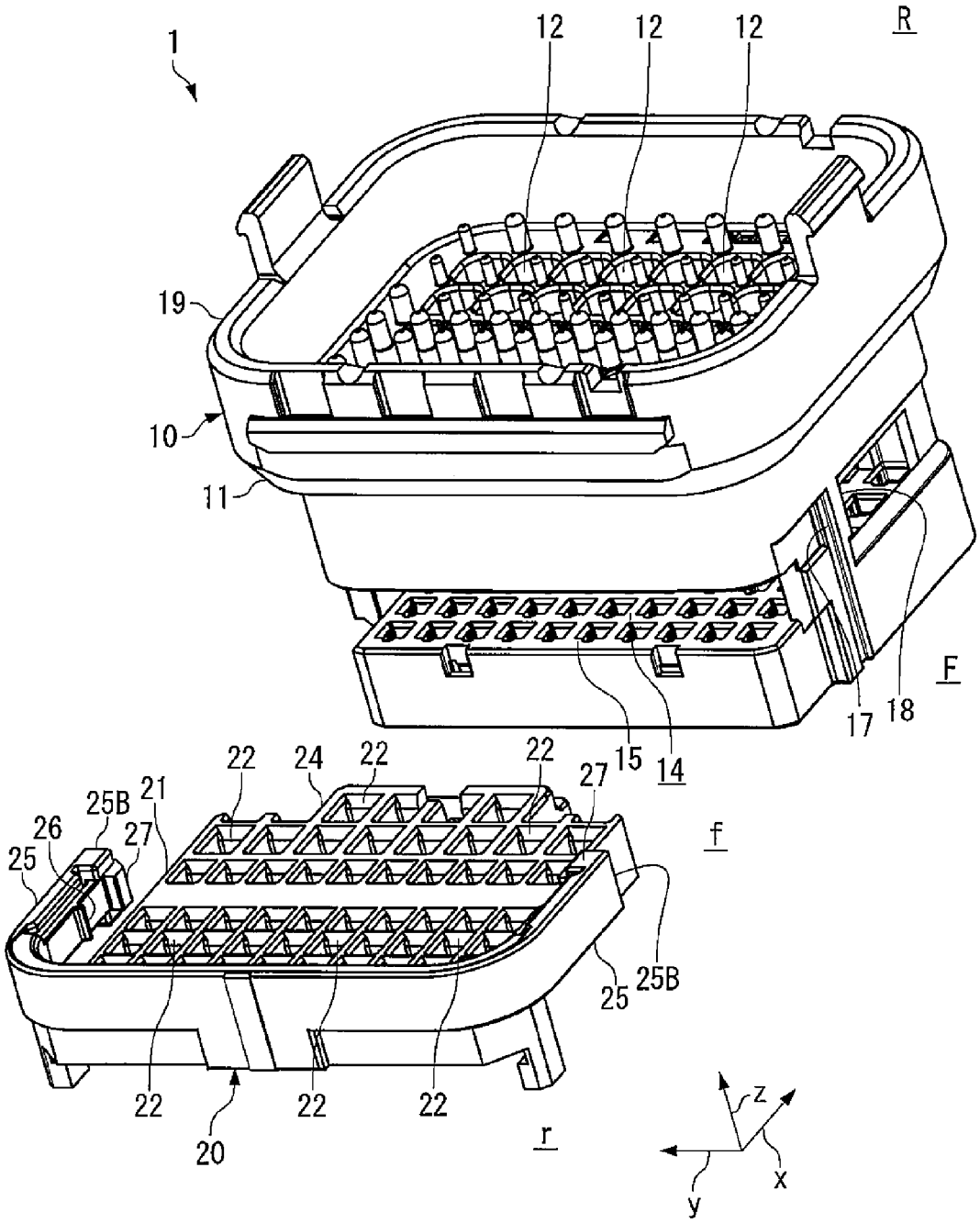
FIG. 2 is a perspective view illustrating the connector from which the retainer has been removed.

As shown in FIGS. 1 and 2, the connector 1 includes a housing 10 that receives terminals 30 (see FIGS. 6 and 7) and a retainer 20 manufactured independently of the housing 10. The retainer 20 is attached to the housing 10 so as to be movable between a pre-latch position (see FIG. 6) and a complete latch position (see FIG. 7). The connector 1 is mated with a mating-side connector (hereinafter, called "mating connector") (not shown) to serve for transmission of an electric signal/power. The housing 10 and the retainer 20 are formed respectively by injection-molding them from insulating resin.

Incidentally, in the connector 1, a lower side thereof mated with the mating connector in FIGS. 1 2 is defined as a front F, while an upper side thereof from which wires 31 (see FIGS. 6 and 7) connected to the terminals 30 are drawn out in FIGS. 1 and 2 is defined as a rear R. Further, an x-axis direction shown in FIGS. 1 and 2, is defined as a height direction, a y-axis direction is defined as a widthwise direction, and a z-axis direction is defined as a front-rear direction.

Normally, the connector 1 is transported from a manufacturer of the connector 1 to a user assembling the connector 1 into equipment in such a state that the retainer 20 has been attached to the pre-latch position. The user moves the retainer 20 to the complete latch position after inserting the terminals 30 into the housing 10. Thereby, the terminals 30 are prevented from getting out of the housing 10 by the retainer 20. The retainer 20 may be returned to the pre-latch position after being moved to the complete latch position. Thus, there are such cases when the retainer 20 is operated to move between the complete latch position and the pre-latch position repeatedly, and it is desired to reduce an operating force in such cases.

Figure 6A:
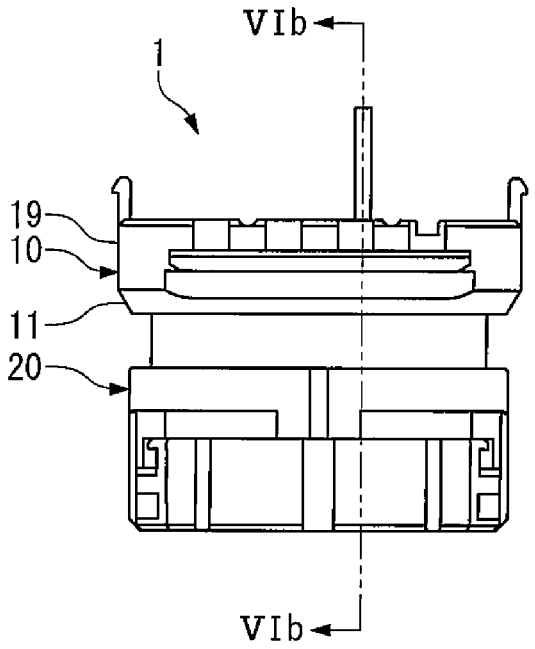
FIGS. 6(*a*) and 6(*b*) show the connector where the retainer is located at the pre-latch position, FIG. 6(*a*) being a front view of the connector and FIG. 6(*b*) being a cross sectional view taken along a line VIb-VIb in the FIG. 6(*a*)
Figure 6B:
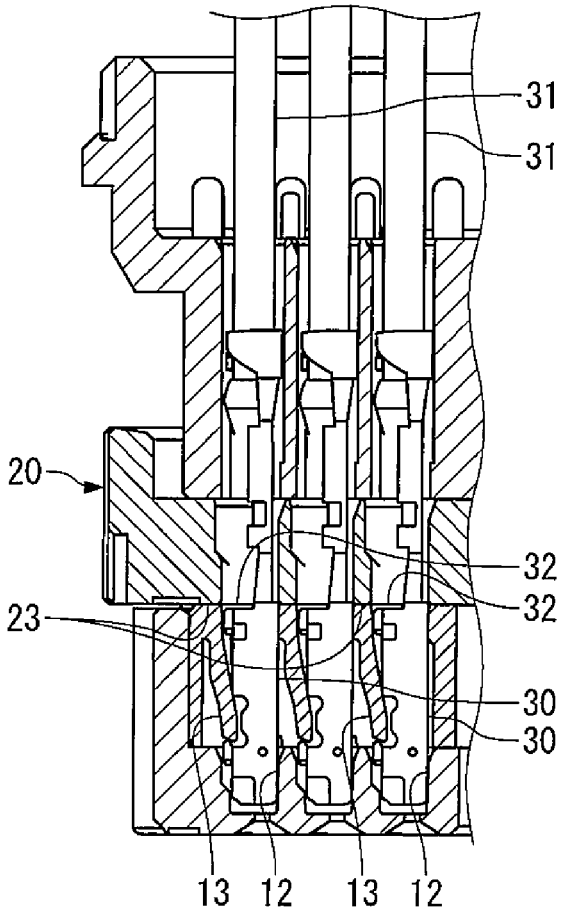

As shown in FIGS. 1 and 2, the housing 10 includes a housing body 11 and a plurality of terminal receiving spaces 12 extending through the housing body 11 in the front-rear direction to receive the terminals 30. As shown in FIGS. 6(*b*) and 7(*b*), the housing body 11 is provided with lances 13 projecting toward the terminal receiving spaces 12. The terminals 30, inserted in a predetermined position in the terminal receiving spaces 12, are caught by the lances 13 so that retaining of the terminals 30 is achieved thus preventing the terminals 30 from getting out of the housing body 11. The connector 1 is provided with the retainer 20 for supplementing a primary retaining obtained by the lances 13. When the retainer 20 is pushed into the complete latch position, a secondary retaining is achieved by catching the terminals 30, as described later.

As shown in FIG. 2, the housing 10 is provided with a retainer receiving passageway 14 in which the retainer 20 is inserted.

Figure 4A:
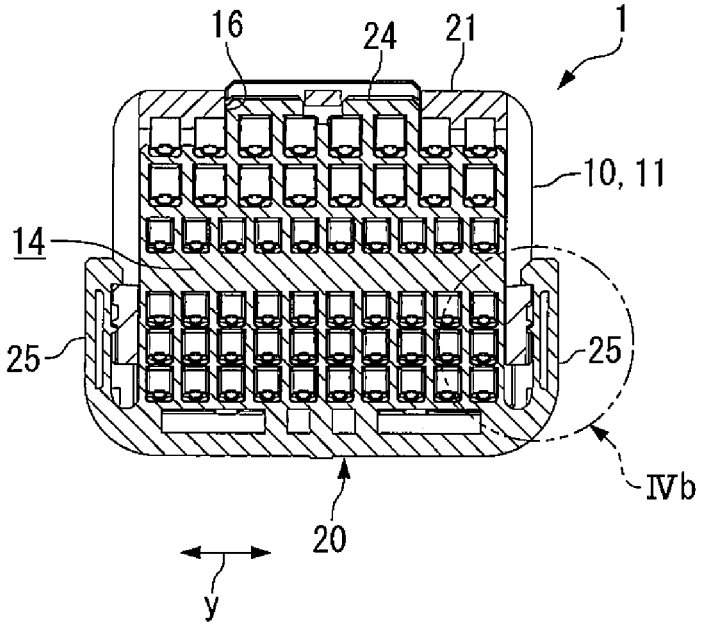
FIGS. 4(*a*) and 4(*b*) show the connector where the retainer is located at a pre-latch position, FIG. 4(*a*) being a cross section of a portion of the connector including the retainer, and FIG. 4(*b*) being an enlarged view of a portion IVb in FIG. 4(*a*)
Figure 4B:
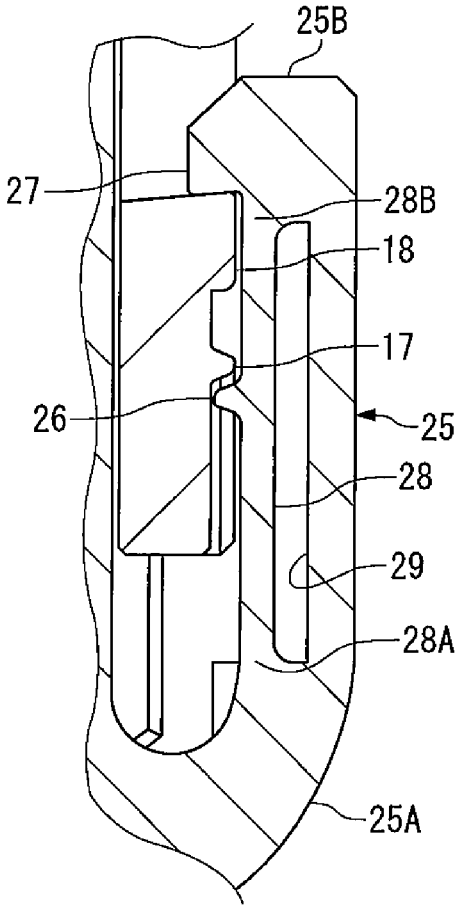

The retainer receiving passageway 14 includes an terminal receiving passageway 15 opening toward a side face of the housing body 11 in the height direction x and a support receiving passageway 16 (see FIGS. 4(*a*) and 5(*a*)) opening toward the other side face of the housing body 11 in the height direction x, and an approximately rectangular parallelepiped gap is formed between the terminal receiving passageway 15 and the support receiving passageway 16. The retainer 20 is inserted into the retainer receiving passageway 14 from the terminal receiving passageway 15, and when it is pushed at least up to the pre-latch position, a distal end 24 thereof is inserted into the support receiving passageway 16.

The retainer 20 is retracted at a position where it avoids interference with the terminals 30, namely, at the pre-latch position until the retainer 20 is inserted from the terminal receiving passageway 15 and the terminals 30 are inserted into the terminal receiving spaces 12. When the retainer 20 is inserted to the complete latch position which is positioned at a depth of the retainer receiving passageway 14 after the insertion of the terminals 30, it interferes with the terminals 30 so that the terminals 30 are prevented from getting out of the housing 10.

As shown in FIGS. 2 and 4, the housing 10 has a second latch 17 and first latch 18 formed on both side faces thereof in the widthwise direction y. The second latch 17 and the first latch 18 are formed integrally with the housing body 11 in this order from the side of the terminal receiving passageway 15. The second latch 17 and the first latch 18 are set to have the same size projecting from the side face, but sizes thereof in the height direction x are formed such that the first latch 18 is longer than the second latch 17. This is because the first latch 18 secures a retaining function of the retainer 20 reliably.

Further, as shown in FIGS. 1 and 2, the housing 10 has a seal retaining wall 19 provided on a circumferential edge of a rear end of the housing body 11 so as to extend rearward, a wire seal (not shown) is attached in a gap enclosed by the seal retaining wall 19. The wire seal is a family seal grommet for blocking entrance of water into the housing body 11 from behind.

Figure 3A:
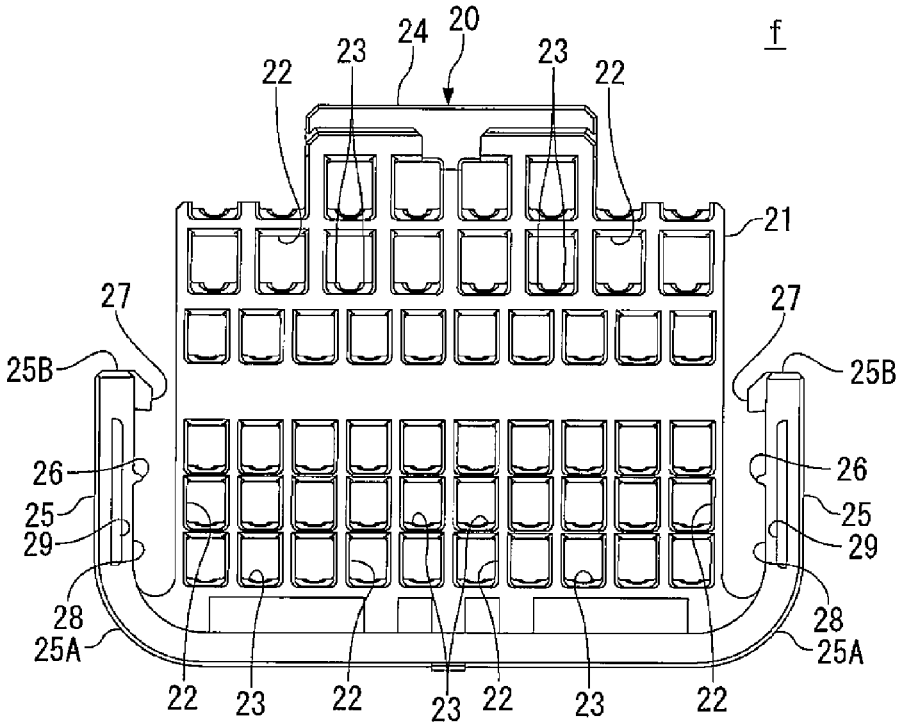
FIGS. 3(*a*) and 3(*b*) show the retainer shown in FIGS. 1 and 2 alone, FIG. 3(*a*) being a plan view of the retainer and FIG. 3(*b*) being a front view thereof.
Figure 3B:
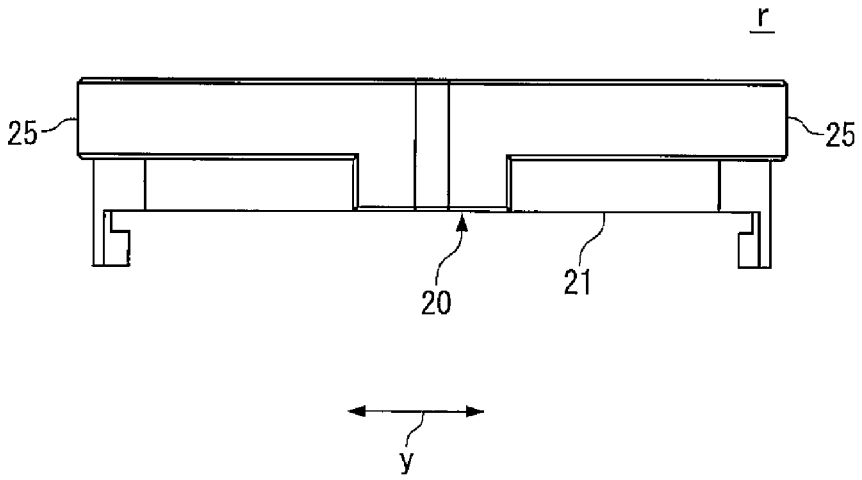

As shown in FIGS. 2 to 4, the retainer 20 having a retainer body 21 inserted into the retainer receiving passageway 14 and a pair of first elastic beams 25, 25 provided on both sides of the retainer body 21 (both ends along the widthwise direction y).

The retainer body 21 has such an outer shape and a size that it is inserted into the retainer receiving passageway 14 of the housing 10 substantially closely.

The retainer 21 includes a plurality of terminal receiving passageways 22 formed so as to extend through the front and the back thereof. The respective terminal receiving passageways 22 are provided at pitches similar to those of the terminal receiving spaces 12 of the housing body 11. The retainer body 21 includes terminal catch 23 (see 7(*b*)) projecting inwardly in the respective terminal receiving passageways 22, and when the retainer 20 is pushed into the complete latch position, the terminal catch 23 catch the terminals 30 to retain the terminals 30.

Incidentally, in the retainer 20, a side thereof (an upper side in FIG. 3(*a*)) which is first inserted in the retainer receiving passageway 14 is defined as a front f, while the opposite side thereto (a lower side in FIG. 3(*a*)) is defined as a rear r.

As shown in FIGS. 3 and 4, the pair of first elastic beams 25, 25 are cantilever-type members having fixed ends 25A integrally connected to the retainer body 21 at a rear end of the retainer body 21, and are configured so as to be elastically deformable to be bent in the widthwise direction y upon receipt of a load in the widthwise direction y.

Each first elastic beam 25 is provided approximately in parallel with the retainer body 21 except for the fixed end 25A, and it is integrally formed with the complete latch projection 26 and the pre-latch projection 27 on a side face thereof facing the retainer body 21. The complete latch projection 26 and the pre-latch projection 27 are arranged in this order from the side of the fixed end 25A of the first elastic beam 25. The complete latch projection 26 is provided in an approximately central portion of the first elastic beam 25 in the front-rear direction, while the pre-latch projection 27 is provided approximately at a free end 25B of the first elastic beam 25.

When the retainer 20 is located at the pre-latch position, the pre-latch projections 27 are caught by the first latches 18 of the housing 10, so that the retainer 20 is retained. Further, when the retainer 20 is located at the complete latch position, the complete latch projections 26 are caught by the second latches 17 of the housing 10, so that the terminals 30 are retained.

The pre-latch projection 27 is configured in order to secure a retaining function of the retainer 20 such that a projection size thereof is made large so that a catching allowance thereof with the first latch 18 is made large. On the other hand, the complete latch projection 26 is configured in order to make small operation forces required for an operation from a pre-latching to a complete latching and an operation force reversal thereto such that a projection size is made small so that a catching allowance thereof with the second latch 17 is made small.

However, even if the catching allowances of the second latch 17 and the second latch projection 26 are made small, when operations for the pre-latching and the complete latching are repeated, distal ends of both the second latch 17 and the second latch 26 are scraped. Therefore, as shown in FIG. 3, the retainer 20 is configured in order that the distal ends are prevented from being scraped such that a second elastic beam 28 is provided on the first elastic beam 25 and the complete latch projection 26 is supported by the second elastic beam 28.

The second elastic beam 28 is configured such that both ends thereof are supported on the cantilever-type first elastic beam 25 by forming a slit 29 extending through a front and a rear of the first elastic beam 25 along a longitudinal direction of the first elastic beam 25. The slit 29 is formed over an approximately entire region of the first elastic beam 25 in the front-rear direction thereof except for the vicinity of the fixed end 25A and the vicinity of the free end 25B. Fixed ends 28A, 28B of the second elastic beam 28 are provided at a front end side and a rear end side of the slit 29. The complete latch projection 26 is provided at an approximately central portion of the second elastic beam 28 in the front-rear direction. The second elastic beam 28 is configured so as to be elastically deformable to be bent in the widthwise direction y upon receipt of a load in the widthwise direction y. When the complete latch projection 26 passes over the second latch 17 in the course of movement of the retainer 20 from the pre-latch position to the complete latch position, the second elastic beam 28 receives a concentrated load via the complete latch projection 26 to bend. Thereby, a force generated at a contact between the complete latch projection 17 and the complete latch projection 26 is reduced, so that the above-described second latch 17 and complete latch projection 26 are prevented from being scraped.

Such a configuration is adopted that when the above-describing bending occurs in the second elastic beam 28 in the course of movement of the retainer 20 from the pre-latch position to the complete latch position, the first elastic beam 25 is also bent in conjunction with the second elastic beam 28.

Next, a catching relationship between the second latch 17 and the first latch 18 of the housing 10, and the complete latch projection 26 and the pre-latch projection 27 of the retainer 20 when the retainer 20 is located at the pre-latch position and the complete latch position will be described with reference to FIGS. 4 and 5.

As shown in FIG. 4, when the retainer 20 is located at the pre-latch position, the pre-latch projection 27 of the retainer 20 is caught to the first latch 18 of the housing 10, so that the retainer 20 is retained so as to prevent getting out of the housing 10. On the other hand, the complete latch projection 26 of the retainer 20 is located just before the second latch 17 of the housing 10. At the pre-latch position, as shown in FIG. 6, in the retainer 20, the terminal catch 23 is separated from the catch end 32 of the terminal 30, so that interference with the terminal 30 is avoided. However, the terminal 30 is primarily retained by the lance 13.

Figure 5A:
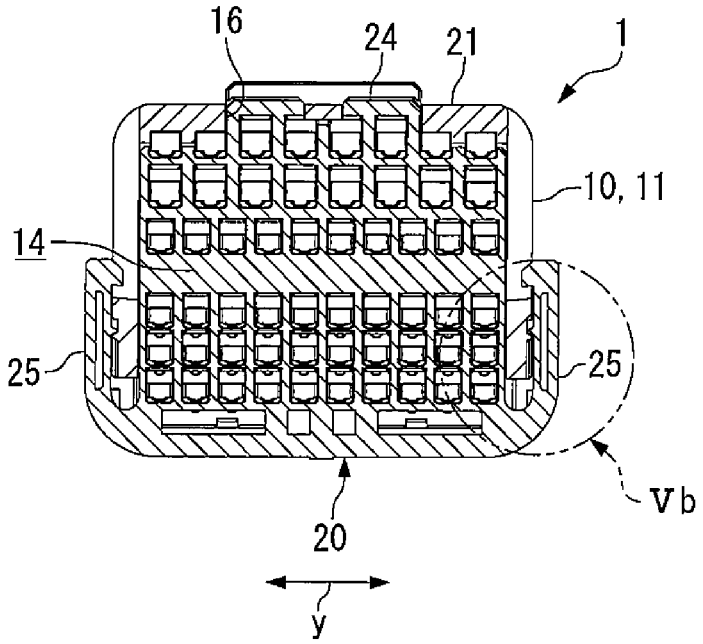
FIGS. 5(*a*) and 5(*b*) show the connector where the retainer is located at a complete latch position, FIG. 5(*a*) being a cross section of a portion of the connector including the retainer and FIG. 5(*b*) being an enlarged view of a portion Vb in FIG. 5(*a*)
Figure 5B:
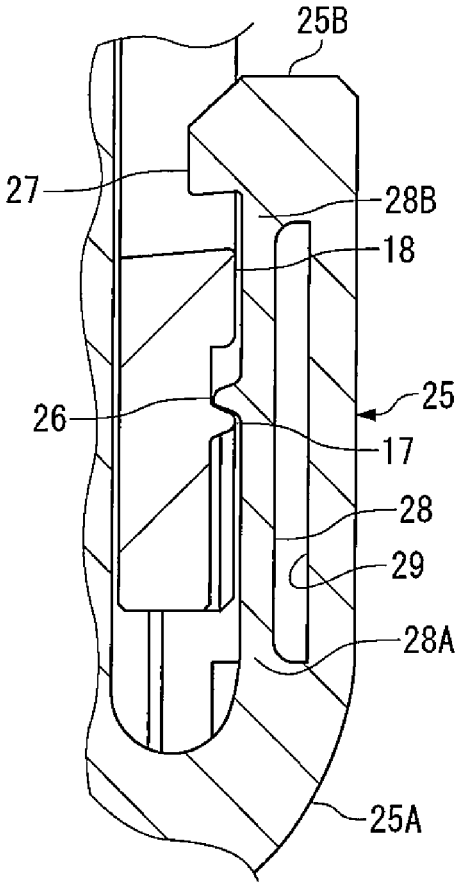
Figure 7A:
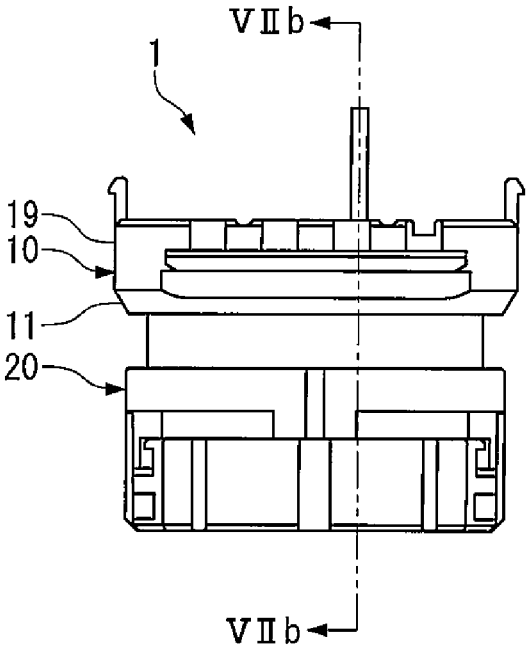
FIGS. 7(*a*) and 7(*b*) show the connector where the retainer is located at the complete latch position, FIG. 7(*a*) being a front view of the connection and FIG. 7(*b*) being a cross sectional view taken along a line VIIb-VIIb in the FIG. 7(*a*)
Figure 7B:
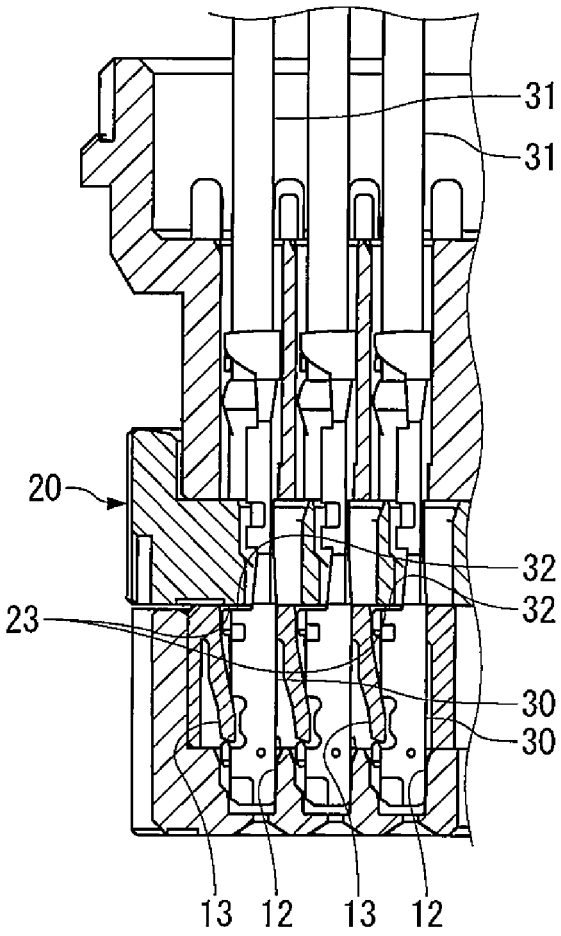
Figure 8A:
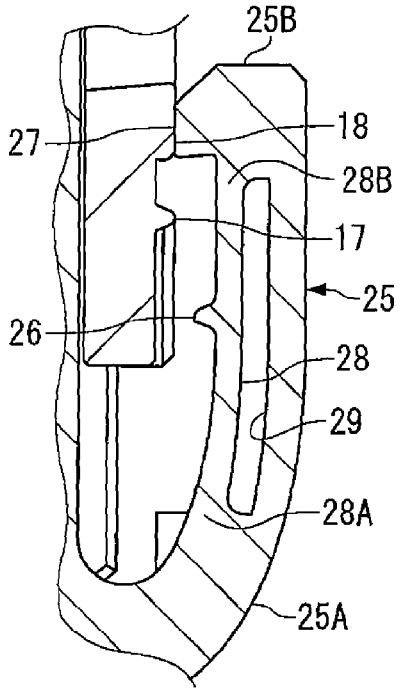
FIGS. 8(*a*) to 8(*d*) show a course of cross sectional views of the retainer in the course of being attached to the housing.
Figure 8B:
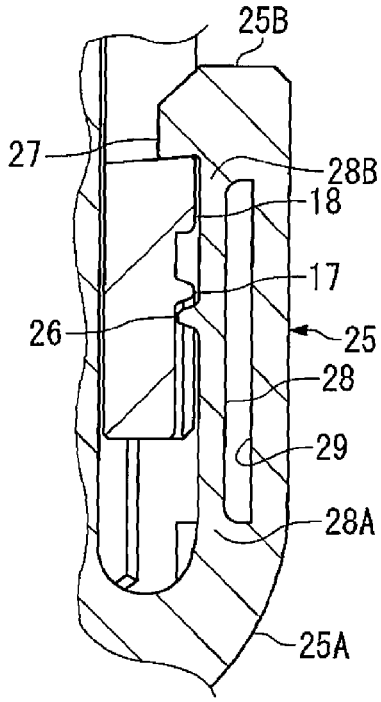
Figure 8C:
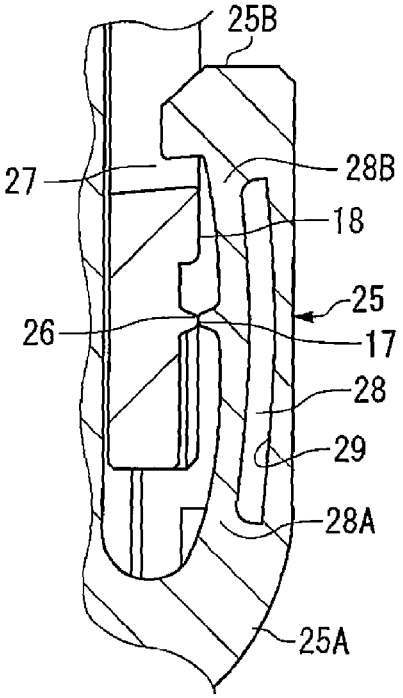
Figure 8D:
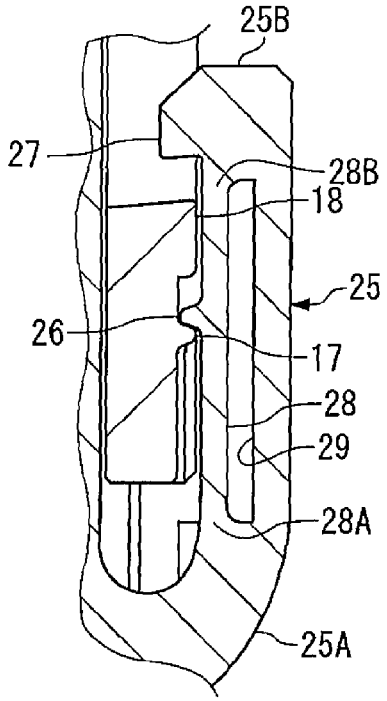
Figure 8D:
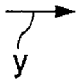

As shown in FIG. 5, when the retainer 20 moves to the complete latch position, the pre-latch projection 27 of the retainer 20 is separated from the first latch 18 of the housing 10, but since the pre-latch projection 27 still remains at a position which has passed over the first latch 18, the retaining function is maintained. On the other hand, the complete latch projection 26 of the retainer 20 passes over the second latch 17 of the housing 10. In the complete latch state, as shown in FIG. 7, in the retainer 20, the terminal catch 23 is pushed to a position interfering with the catch end 32 of the terminal 30, so that the terminal 30 is secondarily retained.

Next, with reference to FIG. 8, bending behaviors of the first elastic beam 25 and the second elastic beam 28 in the course of insertion of the retainer 20 into the retainer receiving passageway 14 of the housing 10 will be described.

First, in the middle where the pre-latch projection 27 of the first elastic beam 25 passes over the first latch 18 of the housing 10, as shown in FIG. 8(*a*), the first elastic beam 25 serving as the cantilever displaces such that the free end 25B faces outward in the widthwise direction y to bend. At this time, since a load is not applied to the complete latch projection 26 so that the second elastic beam 28 is not bent, elastic bending occurs only in the first elastic beam 25 serving as the cantilever.

When the retainer 20 is further pushed toward the bottom of the retainer receiving passageway 14, the pre-latch projection 27 passes over the first latch 18 so that the retainer 20 reaches the pre-latch position, as shown in FIG. 8(*b*). The connector 1 is ordinarily delivered from a manufacturer to a user in a state where the retainer 20 is put at the pre-latch position.

In the course of movement of the retainer 20 from the pre-latch position to the complete latch position upon pushing-in, as shown in FIG. 8(*c*), the complete latch projection 26 of the retainer 20 rides on the second latch 17 of the housing 10. At this time, since the complete latch projection 26 receives a load outward in the widthwise direction y, the second elastic beam 28 receives the concentrated load at the position of the complete latch projection 26, so that the elastic bending occurs where the position is the maximum displacement. Incidentally, at this position, the free end 25B may be located further outside. When the retainer 20 is further pushed in, as shown in FIG. 8(*d*), the complete latch projection 26 passes over the second latch 17 and the retainer 20 reaches the complete latch position. In the course of the complete latch projection 26 passing over the second latch 17, an elastic bending occurs in the first elastic beam 25 serving as the cantilever.

As described above, the retainer 20 mainly has the first elastic beam 25 bent in the course of an operation for the pre-latching, and the second elastic beam 28 is bent in the course of an operation for the complete latching. The retainer 20 thus has a dual bending structure composed of the first elastic beam 25 and the second elastic beam 28.

An advantageous effect of the connector 1 having the above configuration will be described.

As described above, in the connector 1, the retainer 20 having the dual bending structure, the second elastic beam 28 is set such that its rigidity becomes low in order that a small force is required for a mutual operation between the pre-latching and the complete latching.

Since the connector 1 receives a stress occurring in the complete latch projection 26 through the second elastic beam 28 to be bent when the complete latch projection 26 of the retainer 20 passes over the second latch 17 of the housing 10, the second latch 17 and the complete latch projection 26 can be prevented from being scraped during the mutual operation between the pre-latching and the complete latching.

Further, in the connector 1, the complete latch projection 26 and the pre-latch projection 27 are provided on the second elastic beam 28 and the cantilever-type first elastic beam 25, respectively. Therefore, while a mutual operational force between the pre-latching and the complete latching is being reduced, retaining of the retainer 20 can be performed reliably.

Next, in the connector 1, since the complete latch projection 26 and the pre-latch projection 27 are provided on the same side of the first elastic beam 25 in the widthwise direction y, the size of the first elastic beam 25 in the widthwise direction y can be reduced. Further, in the connector 1, since the second elastic beam 28 is formed by providing the slit 29 in the first elastic beam 25 having a constant width, it is unnecessary to make the width of first elastic beam 25 large. Therefore, the size of the connector 1 including the retainer 20 in the widthwise direction y can be reduced.

Though the preferred embodiment of the invention has been described above, choices can be made from the configurations described in the above embodiment and modification to another configuration can be made properly without departing from the invention.

Figure 9:
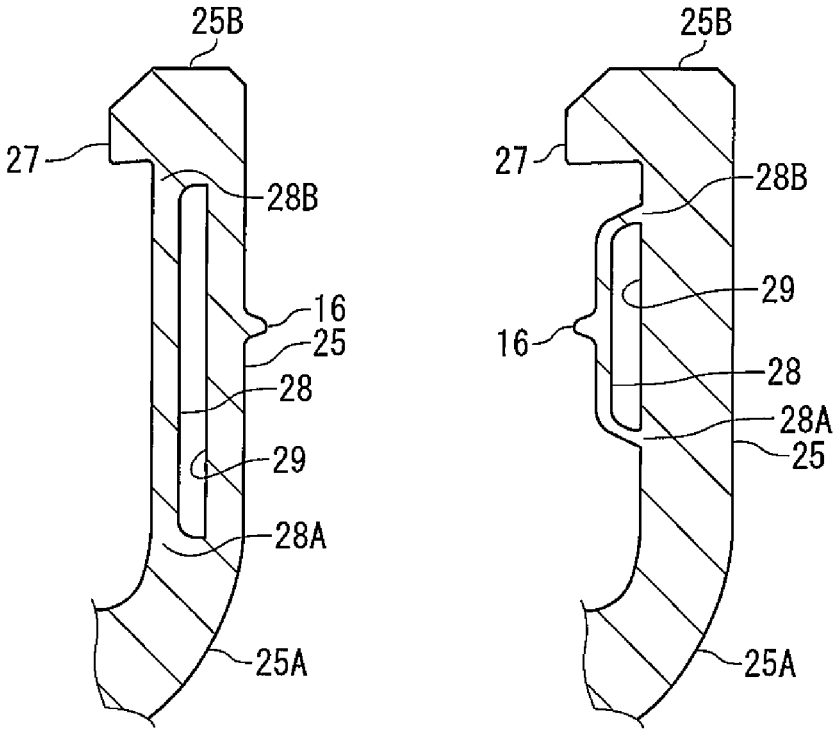
FIG. 9 is a cross sectional view showing modified examples of the retainer of the invention.

In the above description, the example describes the complete latch projection 26 and the pre-latch projection 27 provided on the same side of the first elastic beam 25 in the widthwise direction y, but the invention is not limited to this example, and the complete latch projection 26 and the pre-latch projection 27 may be provided on different sides of the rock arm 25 in the widthwise direction, as shown in FIG. 9(*a*). In this case, it is necessary to provide the positions at which the second latch 17 and the first latch 18 of the housing 10 are provided so as to correspond to the different sides of the first elastic beam 25 in the widthwise direction.

Further, in the above description, the example where the second elastic beam 28 is formed by providing the slit 29 in the first elastic beam 25 having an even width has been described, but the invention is not limited to this example and, as shown in FIG. 9(*b*), only a portion corresponding to the second elastic beam 28 may be formed so as to project in the widthwise direction of lock arm 25.

Further, in the above description, the example where the dual bending structure has been applied to the connector 1 for latching the retainer 20 to the housing 10 has been described, but the invention is not limited to this example and it can be widely applied to a structure for assembling members each having two latch projections.

That is, the invention can be grasped as a latching structure held by an object to be caught so as to be movable between a first latch position and a second latch position. This latching structure having the first latch projection caught to the object to be caught at the first latch position, the second latch projection caught to the object to be caught at the second latch position, the cantilever-type first elastic beam having the free end side formed with the first latch projection, and the second elastic beam having both ends supported to the first elastic beam and formed with the second latch projection.

It should be appreciated that while the detailed description was made in terms of the shown embodiments of the invention, the invention may pursue various modifications and add improvements, without being limited to the above disclosure.

What is claimed is:

1. An electrical connector comprising:

a connector housing having a plurality of terminal receiving spaces in which terminals are received; and a retainer held in the connector housing so as to be movable between a pre-latch position and a complete latch position and retaining the terminals at the complete latch position, wherein the connector housing comprises:

a first latch at the pre-latch position; and a second latch at the complete latch position; and the retainer comprises:

a cantilever-type first elastic beam having a free end side formed with a pre-latch projection; and a second elastic beam having both ends supported by the first elastic beam and formed with a complete latch projection, the first elastic beam and the second elastic beam elastically bending in a same direction upon respective contact with the connector housing.

2. The electrical connector according to claim 1, wherein the second elastic beam is formed on a portion of the first elastic beam by providing a slit extending in a longitudinal direction in the first elastic beam.

3. The electrical connector according to claim 1, wherein the complete latch projection is formed on the same side as the side of the first elastic beam formed with the pre-latch projection.

4. A latching structure held by an object to be caught so as to be movable between a first latch position and a second latch position, wherein the latching structure comprises:

a first latch projection engaging the object to be caught at the first latch position;

a second latch projection engaging the object to be caught at the second latch position;

a cantilever-type first elastic beam having a free end side formed with the first latch projection; and a second elastic beam having both ends supported by the first elastic beam and formed with the second latch projection, the first elastic beam and the second elastic beam elastically bending in a same direction upon respective contact with the object to be caught.

5. An electrical connector comprising:

a connector housing provided with a plurality of terminal receiving spaces in which terminals are received; and a retainer held in the connector housing so as to be movable between a pre-latch position and a complete latch position and retaining the terminals at the complete latch position, wherein the retainer comprises:

a pre-latch projection caught to the connector housing at the pre-latch position;

a complete latch projection caught to the connector housing at the complete latch position;

a cantilever first elastic beam having a free end side formed with the pre-latch projection; and a second elastic beam having both ends supported by the first elastic beam and formed with the complete latch projection, the first elastic beam and the second elastic beam elastically bending in a same direction upon respective contact with the connector housing.

* * * * *